US008333101B2

(12) United States Patent
Shields

(10) Patent No.: US 8,333,101 B2
(45) Date of Patent: Dec. 18, 2012

(54) SHIFTABLE TRANSFER APPARATUS FOR TRANSFERRING WORKPIECE TO PRESS

(75) Inventor: Jay Shields, Gadsden, AL (US)

(73) Assignee: Honda Motor Co., Ltd., Tokyo (JP)

( * ) Notice: Subject to any disclaimer, the term of this patent is extended or adjusted under 35 U.S.C. 154(b) by 322 days.

(21) Appl. No.: 12/870,168

(22) Filed: Aug. 27, 2010

(65) Prior Publication Data

US 2012/0047985 A1 Mar. 1, 2012

(51) Int. Cl.
*B30B 15/30* (2006.01)

(52) U.S. Cl. ..... 72/405.05

(58) Field of Classification Search ..... 72/405.01, 72/405.05, 405.11, 405.13, 419–421
See application file for complete search history.

(56) References Cited

U.S. PATENT DOCUMENTS 4,557,134 A * 12/1985 Kuppinger ..... 72/405.05
4,981,031 A * 1/1991 Schneider et al. ..... 72/405.05
5,159,827 A 11/1992 Shiraishi et al.
5,586,495 A 12/1996 Ogawa et al.
5,992,207 A 11/1999 Hofele et al.
6,073,551 A 6/2000 Dangelmayr et al.
7,219,525 B2 * 5/2007 Kawamoto ..... 72/405.11
2008/0216546 A1 * 9/2008 Kong ..... 72/405.05
2008/0264274 A1 10/2008 Haller et al.

* cited by examiner

*Primary Examiner* — Faye Francis
(74) *Attorney, Agent, or Firm* — Standley Law Group LLP

(57) ABSTRACT

A shiftable workpiece transfer apparatus for transferring a workpiece to a press while simultaneously shifting the workpiece centerline. Such a transfer apparatus includes cooperating workpiece transfer tables, the movement of which is directed by respective guide rails. A first workpiece transfer table is directed along a path that is substantially parallel to the centerline of the press line. The second workpiece transfer table is directed along a path that is skewed with respect to the centerline of the press line by an amount sufficient to produce a desired shift of the workpiece centerline. As the second transfer table moves along the skewed guide rail and toward the first transfer table, the workpiece is automatically moved across the surface of the first transfer table to a desired centerline offset point.

16 Claims, 3 Drawing Sheets

SHIFTABLE TRANSFER APPARATUS FOR TRANSFERRING WORKPIECE TO PRESS

BACKGROUND OF THE INVENTIVE FIELD

The present invention is directed to a workpiece transfer apparatus for transferring a workpiece to a press. More particularly, the present invention is directed to a shiftable workpiece transfer apparatus for transferring a workpiece to a press while simultaneously shifting the workpiece centerline.

The use of a press to form (draw), trim, bend, pierce or otherwise operate on a sheet metal workpiece is well known. For the sake of simplicity only, all such operations will be referred to herein as "stamping" operations. Such stamping operations are commonly employed, for example, to create vehicle body panels. Depending on the component of interest, and on the specific stamping operation being performed, a single press or a series of presses may be employed.

In either case, a sheet metal blank to be operated upon must be supplied to the press or to each press in a press line for creation of a workpiece of interest. In manufacturing operations, such as vehicle manufacturing operations, these sheet metal blanks are typically supplied in an automated fashion. A number of apparatus may be used for this purpose including, for example, conveyors of various types, walking beam mechanisms, vacuum-based transfer frames and robotic arms. In the case of a single press, the sheet metal blank is supplied to the die, whereafter it is operated upon and then removed from the press to a downstream location. In the case of a press line, the sheet metal blank is supplied to the die in the first press, and then subsequently transferred to one or more following presses in the press line for further manipulation. A press line having multiple presses, each with its own die, is often referred to as a progressive die line. In such a press line, a workpiece is transferred from one press to a subsequent press, such as by one of the transfer mechanisms described above.

In some progressive die operations, a single die may be used to simultaneously operate on more than one sheet metal blank. For example, in a vehicle manufacturing operation, the stamping of a left and right fender or left and right door may be simultaneously performed on a single die. In this case, it is possible and known to use a pair of transfer tables to laterally outwardly shift both workpieces an equal distance during the transfer thereof from one press to a next press. This may be necessary to further separate the workpieces as they are moved from one die to a subsequent and different operation on a next die.

Workspace openings and other physical characteristics of presses and related equipment typically limit the size of a die that may be installed thereto and, therefore, the size of a workpiece that can be stamped. Thus, if it is desired to stamp a larger than typical workpiece, atypical processing steps may be required. For example, in relation to the present invention, an increase in the overall size of a vehicle side panel outer (SPO) workpiece dictates that the centerline of the workpiece be shifted with respect to the centerline of an associated press line as the SPO is moved from one press to a subsequent press. Such shifting is necessary in this case because the increased size of the particular SPO requires an offset of certain die components with respect to the centerline of preceding die (and workpiece). Obviously, the case of a SPO workpiece is used for purposes of illustration only, and the present invention is not limited to use in a process for making any particular workpiece.

The press line on which the SPO of the aforementioned example is manufactured is equipped with a pair of transfer tables, as described above. The exemplary SPO workpiece spans both of these transfer tables and, therefore, both transfer tables are used to transfer the SPO workpiece. While these existing transfer tables are capable of an equidistant lateral shift while moving from one press to the next, they are incapable of cooperating to shift a single workpiece in one lateral direction.

Therefore, it is desirable to be able to shift the centerline of a single workpiece during transfer from one press/die to the next using a pair of workpiece transfer tables that typically may be moved only in a straight line or in opposite lateral directions. Embodiments of the present invention are directed to such a workpiece transfer apparatus and method.

SUMMARY OF THE GENERAL INVENTIVE CONCEPT

The present invention is directed to a shiftable workpiece transfer apparatus for transferring a workpiece to a press while simultaneously shifting the workpiece centerline. The present invention may be a new construction or may be a modification to a workpiece transfer apparatus that employs two workpiece transfer tables that typically may be moved only in a straight line or in opposite lateral directions.

As would be understood by one of skill in the art, transfer table mechanisms may be stationed between presses of a press line to transfer workpieces from one press to the next. The transfer tables run along guide rails that direct the movement thereof. The guide rails may run parallel to the centerline of the press line, such that a workpiece or a pair of workpieces are transferred from one press to the next without any offset in the workpiece centerline. As described above, certain embodiments of such transfer table mechanisms may also be capable of simultaneously and laterally shifting in opposite directions the centerlines of a pair of transferred workpieces.

According to the present invention, a dual transfer table workpiece transfer apparatus is modified or constructed to produce a shift in the centerline of a single workpiece while the workpiece is transferred between presses by a cooperative effort of both transfer tables. To this end, the guide rail or other guide mechanism associated with a first of the pair of transfer tables will be directed substantially parallel to the centerline of the press line. In contrast, the guide rail or other guide mechanism associated with the second of the pair of transfer tables is skewed toward (or away from) the first transfer table by an amount sufficient to produce a desired shift of the workpiece centerline.

In one embodiment, the second transfer table may be provided with pins or other workpiece transfer elements that abut an edge(s) of the workpiece so as to laterally push the workpiece across the surface of the first transfer table as the tables cooperatively move from one press to the next. That is, as the second transfer table moves along the skewed guide element and toward the first transfer table, the workpiece will be automatically moved across the surface of the first transfer table toward a desired centerline offset point. The first transfer table may be provided with stop elements that limit overall movement of the workpiece over the table surface and ensure proper location of the shifted workpiece.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1A:
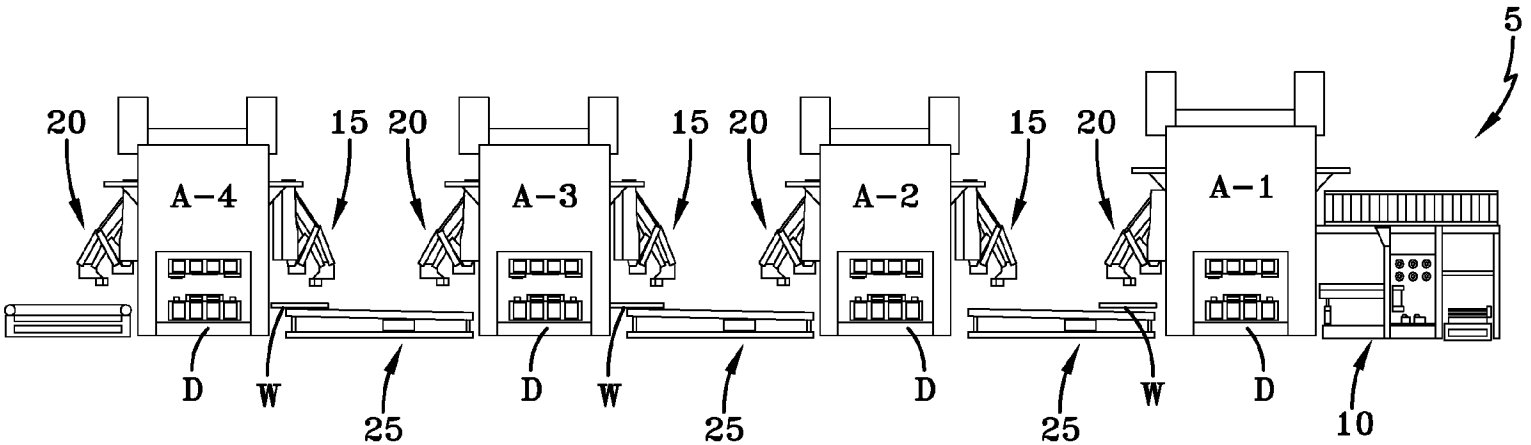
FIG. 1*a* is a side view of an exemplary press line equipped with a an exemplary embodiment of a shiftable workpiece transfer apparatus of the present invention.
Figure 1B:
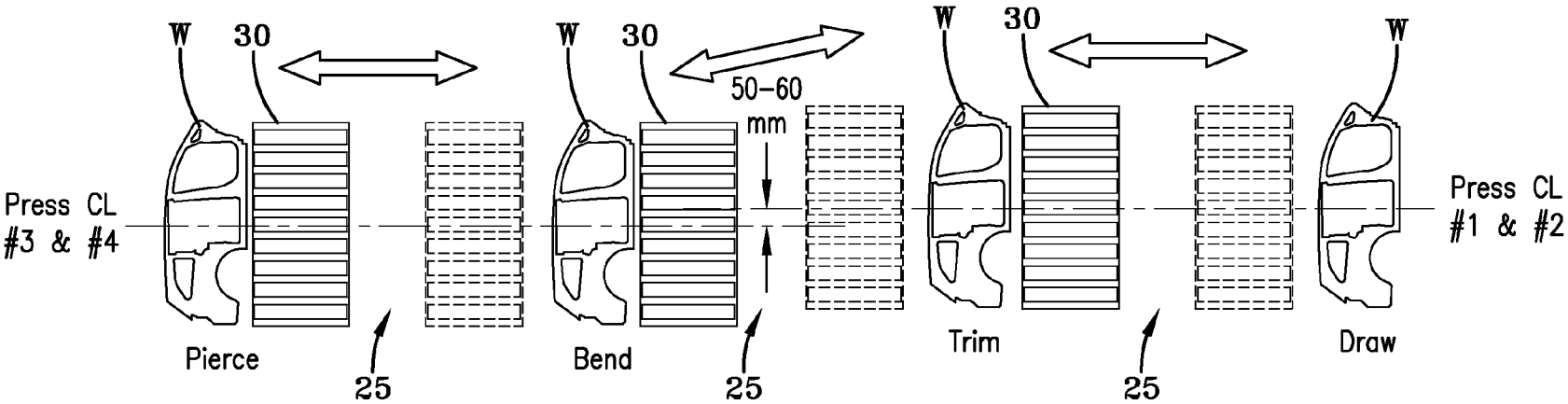
FIG. 1*b* is an overhead view of the arrangement of FIG. 1*a;*

An exemplary stamping press line 5 is illustrated in FIGS. 1*a*-1*b*. In this particular example, the press line is equipped with dies D to produce a workpiece W in the form of a vehicle side panel outer (SPO) component. Of course, other press lines can be used to produce other workpieces, and nothing herein is to be construed as limiting the present invention to the exemplary press line, to the production of a vehicle SPO, or to the field of vehicle manufacture.

As shown in FIGS. 1*a*-1*b*, this particular press line 5 includes four presses A-1 through A-4 which, in this example, correspond to draw, trim, bend, and pierce stations/operations, respectively. Workpieces W move through the press line 5 from right to left (i.e., from press A-1 to press A-4). As is also shown, the press line 5 includes a workpiece feeder apparatus 10 that initially transfers workpieces W to the first press A-1, and each press also includes its own workpiece loading and unloading devices 15, 20, respectively. The workpiece loading devices 15 retrieve workpieces W from a workpiece transfer apparatus 25 located between presses A-1 and A-2, between presses A-2 and A-3, and between presses A-3 and A-4, and load the workpieces onto the dies located respectively in presses A-2, A-3 and A-4. The workpiece unloading devices 20 retrieve workpieces W from the dies and place the workpieces onto the next upstream workpiece transfer apparatus 25 for transfer of the workpieces to the next press in the press line 5.

Figure 2:
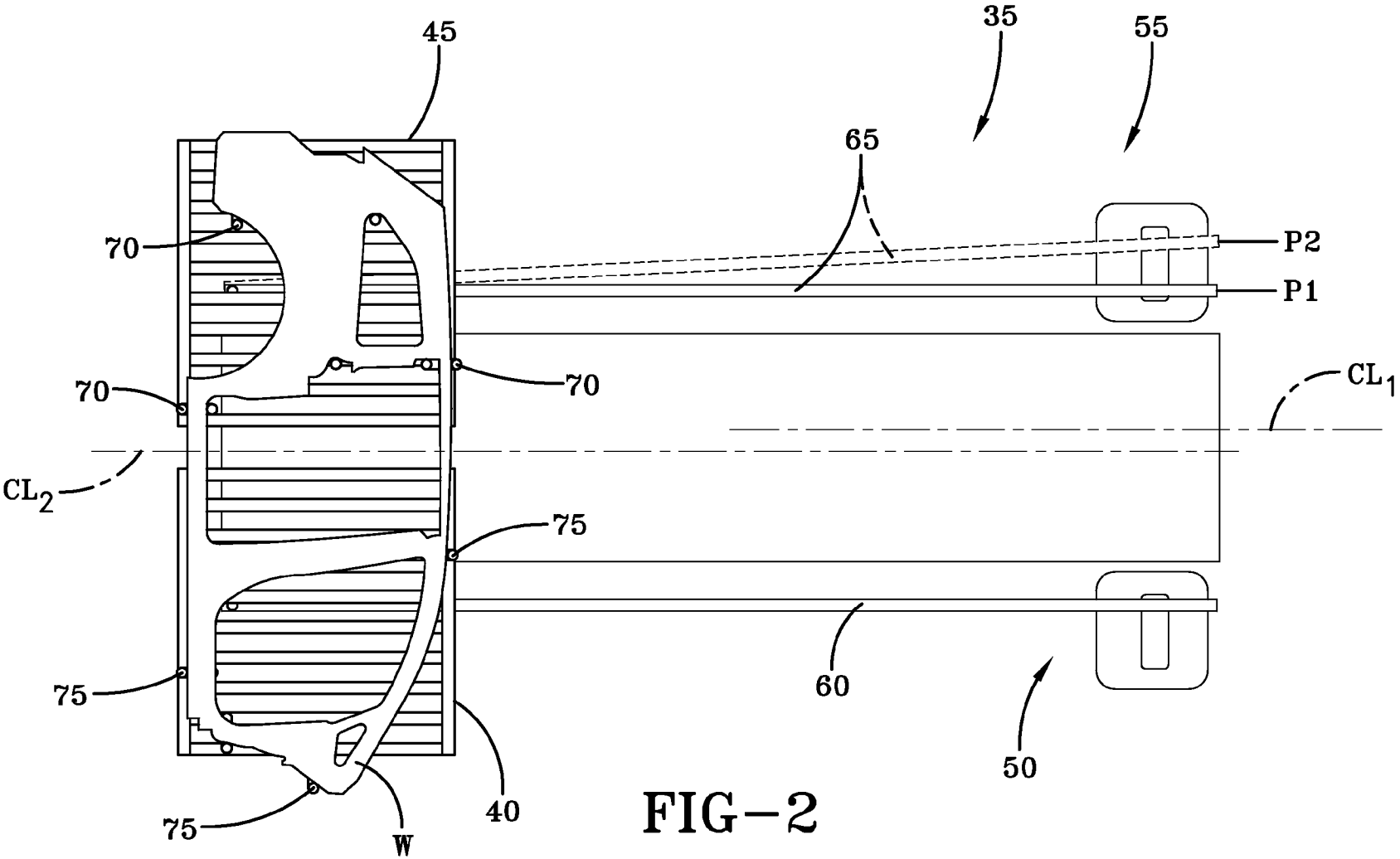
FIG. 2 is an enlarged overhead view of a shiftable workpiece transfer apparatus shown in FIGS. 1*a*-1*b*.
Figure 3:
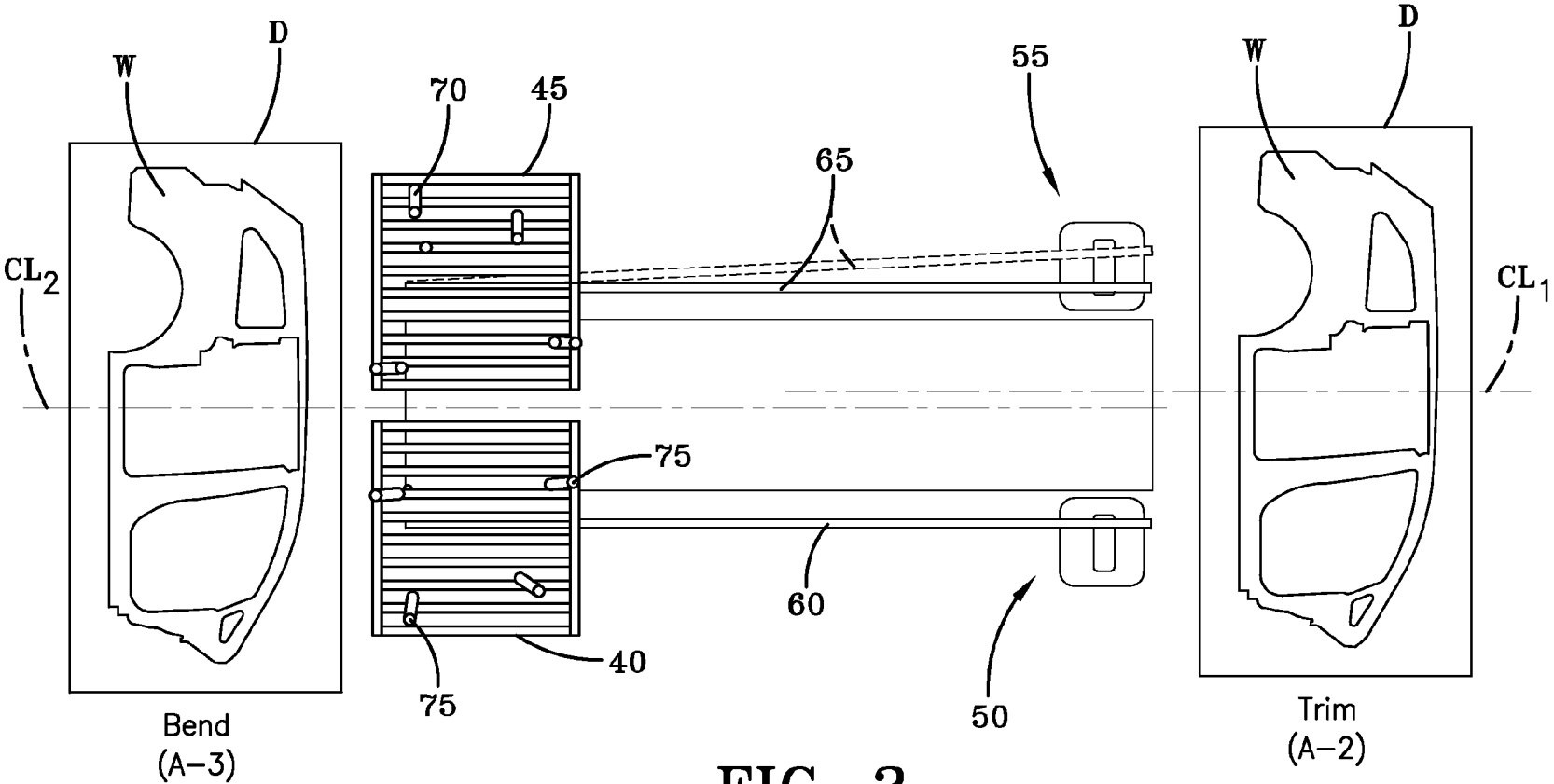
FIG. 3 illustrates how the shiftable workpiece transfer apparatus of FIG. 2 laterally offsets the centerline of a workpiece during delivery from one press/die to the next press/die of the press line.

FIG. 1*b* generally illustrates that each workpiece transfer apparatus 25 of this particular press line 5 may comprise a traveling workpiece transfer table 30 (or a pair of workpiece transfer tables, as shown in FIGS. 2-3). The workpiece transfer tables 30 are directed by guide elements (not shown), such as floor or frame mounted guide rails, etc. Movement of the workpiece transfer tables 30 from one press to the next may be produced by a variety of motive means, all of which would be quite familiar to one of skill in the art and, therefore, need not be discussed in detail herein.

FIG. 1*b* also illustrates that in this particular example, it is required to laterally shift the centerline of each workpiece W as it moves from press A-2 to press A-3. In this particular example, the centerline of the workpieces W must be shifter by approximately 50-60 mm, but this distance is provided for illustrative purposes only and is not to be considered as limiting the scope of the present invention.

The present invention is directed to a shiftable workpiece transfer apparatus that includes a pair of workpiece transfer tables. An exemplary embodiment of a shiftable workpiece transfer apparatus 35 of the present invention is shown in FIGS. 2-3. This shiftable workpiece transfer apparatus 35 is capable of producing a lateral shifting of a workpiece centerline during transfer of a workpiece from one press to the next press of a press line, such as the lateral workpiece shift that is required to occur between presses A-2 and A-3 of the press line 5.

The shiftable workpiece transfer apparatus 35 includes a first workpiece transfer table 40 and a second workpiece transfer table 45. The workpiece transfer tables 40, 45 may be of various design, construction, size and shape, as dictated by the workpieces to be transferred and/or other factors. As shown, the workpiece W is simultaneously supported by both workpiece transfer tables 40, 45. The first workpiece transfer table 40 and second workpiece transfer table 45 work cooperatively to transfer the workpiece W from one press to the next press of a press line.

The workpiece transfer tables 40, 45 are guided during their movement by respective guiding devices 50, 55, each of which includes at least one guide rail 60, 65. The first guide rail 60 is associated with the first workpiece transfer table 40, and is oriented such that the first workpiece transfer table moves along a path that is substantially parallel to the centerlines $CL_1$, $CL_2$ of the presses in the press line to which the shiftable workpiece transfer apparatus 35 has been installed.

In contrast, the second guide rail 65 is moveable between a first position P1 that is substantially parallel to the centerlines $CL_1$, $CL_2$ of the presses in the press line to which the shiftable workpiece transfer apparatus 35 has been installed, and a number of positions between the first position and a second position P2 that extends at some angle from (i.e., is skewed with respect to) said centerline. Consequently, when the second guide rail 65 is in the first position P1, the second workpiece transfer table 45 will move with the first workpiece transfer table 40 along a path that is substantially parallel to the centerlines $CL_1$, $CL_2$ of the presses of the associated press line. However, when the second guide rail 65 is placed in a position in between the first position P1 and the second position P2, the second workpiece transfer table 45 will still move with the first workpiece transfer table 40, but along a path that is at an angle to the centerlines $CL_1$, $CL_2$ of the presses of the associated press such that the second workpiece transfer table moves toward the first workpiece transfer table by some predetermined distance (which is controlled by the position and orientation of the second guide rail 65).

This lateral movement of the second workpiece transfer table 45 causes the workpiece W to shift position along with the second workpiece transfer table by causing a sliding of corresponding portions of the workpiece over the surface of the first workpiece transfer table 40. Consequently, the initial centerline $CL_1$ of the workpiece W is shifted by an amount necessary to align the workpiece centerline with the centerline $CL_2$ of the next press in the press line.

To assist with sliding a workpiece W over the surface of the first workpiece transfer table 40, the second workpiece transfer table 45 may be provided with workpiece shifting elements 70, such as pins, blocks, clamps, etc. These workpiece shifting elements 70 may abut an edge(s) of the workpiece W or otherwise releasably and temporarily secure the workpiece to effectuate its lateral movement across the surface of the first workpiece transfer table 40 as the transfer tables cooperatively move from one press to the next. Additionally, the first workpiece transfer table 40 may be provided with workpiece stop and/or guide elements 75 such as pins, blocks, etc., that limit overall movement of the workpiece W over the surface of the first workpiece transfer table and ensure the proper location and orientation of the shifted workpiece W.

While the exemplary embodiment of the present invention depicted in FIGS. 2-3 and described herein laterally shifts the centerline of a workpiece by pushing it into a new position, it should be apparent to one of skill in the art that alternative embodiments of the present invention may contrarily achieve the same result by pulling/dragging a workpiece into a new position. For example, the embodiment of the shiftable workpiece transfer apparatus shown in FIGS. 2-3 could be modified such that the second workpiece transfer table 45 always moves parallel to the press centerlines while the first workpiece transfer table 40 may move away from the second workpiece transfer table so as to drag the workpiece W into a laterally shifted position. In this regard, appropriately placed workpiece shifting elements and/or workpiece stop and/or guide elements may again be used.

Based on the foregoing descriptions and remarks, it should be obvious to one of skill in the art that while certain embodiments of the present invention are described in detail above, the scope of the invention is not to be considered limited by such disclosure, and modifications are possible without departing from the spirit of the invention as evidenced by the following claims:

What is claimed is:

1. A shiftable workpiece transfer apparatus, comprising:

a first workpiece transfer table located and arranged to move between one press and a subsequent press of a press line;

a first guide rail that directs movement of said first workpiece transfer table along a path that is substantially parallel to the centerlines of the presses in the press line;

a second workpiece transfer table located and arranged to move between the same presses as said first workpiece transfer table, said second workpiece transfer table moving concurrently with said first workpiece transfer table;

a second guide rail that directs movement of said first workpiece transfer table along a path that is skewed with respect to the centerlines of the presses in the press line, such that said second workpiece transfer table moves toward said first workpiece transfer table when the workpiece transfer tables are moved from one press toward a next press in the press line.

2. The shiftable workpiece transfer apparatus of claim 1, wherein the angle of said second guide rail with respect to the centerlines of the presses in the press line is adjustable.

3. The shiftable workpiece transfer apparatus of claim 1, further comprising at least one workpiece shifting element attached to said second workpiece transfer table to temporarily and releasably secure the lateral position of said workpiece thereon.

4. The shiftable workpiece transfer apparatus of claim 1, further comprising at least one stop element attached to said first workpiece transfer table to limit the travel of a workpiece over a top surface of said first workpiece transfer table.

5. The shiftable workpiece transfer apparatus of claim 1, further comprising at least one guide element attached to said first workpiece transfer table to ensure the proper location and orientation of a shifted workpiece.

6. A shiftable workpiece transfer apparatus, comprising:

a first workpiece transfer table located and arranged to move between one press and a subsequent press of a press line;

a first guide rail that directs movement of said first workpiece transfer table along a path that is substantially parallel to the centerlines of the presses in the press line;

a second workpiece transfer table located and arranged to move between the same presses as said first workpiece transfer table, said second workpiece transfer table working in cooperation with said first workpiece transfer table to move a workpiece between said presses;

a second guide rail that directs movement of said first workpiece transfer table along a path that is skewed with respect to the centerlines of the presses in the press line, such that when the workpiece transfer tables are moved from one press to a next press in the press line, said second workpiece transfer table and a workpiece cooperatively carried by said workpiece transfer tables are caused to shift toward said first workpiece transfer table by some predetermined distance.

7. The shiftable workpiece transfer apparatus of claim 6, wherein the angle of said second guide rail with respect to the centerlines of the presses in the press line is adjustable.

8. The shiftable workpiece transfer apparatus of claim 6, further comprising at least one workpiece shifting element attached to said second workpiece transfer table to temporarily and releasably secure the lateral position of said workpiece thereon.

9. The shiftable workpiece transfer apparatus of claim 6, further comprising at least one stop element attached to said first workpiece transfer table to limit the travel of a workpiece over a top surface of said first workpiece transfer table.

10. The shiftable workpiece transfer apparatus of claim 6, further comprising at least one guide element attached to said first workpiece transfer table to ensure the proper location and orientation of a shifted workpiece.

11. A method for shifting the centerline of a workpiece while said workpiece is being transferred from one press to a next press of a press line, said method comprising:

locating a shiftable workpiece transfer apparatus between two presses of a press line, said shiftable workpiece transfer apparatus further comprising:

a first workpiece transfer table located and arranged to move between one press and a subsequent press of said press line, a first guide rail that directs movement of said first workpiece transfer table along a path that is substantially parallel to the centerlines of the presses in said press line, a second workpiece transfer table located and arranged to move between the same presses as said first workpiece transfer table, said second workpiece transfer table working in cooperation with said first workpiece transfer table to move a workpiece between said presses, and a second guide rail that directs movement of said first workpiece transfer table along a path that is skewed with respect to the centerlines of the presses in said press line, such that when the workpiece transfer tables are moved from one press to a next press in said press line, said second workpiece transfer table is caused to move toward said first workpiece transfer table by some predetermined distance, placing a workpiece onto said first and second workpiece transfer tables such that said workpiece is cooperatively supported thereby; and causing said first and second workpiece transfer tables to concurrently move toward a next press in said press line while carrying said workpiece;

whereby said workpiece is caused to shift laterally across said first workpiece transfer table by a distance that substantially aligns its centerline with that of said subsequent press of said press line.

12. The method of claim 11, wherein the angle of said second guide rail with respect to the centerlines of the presses in the press line is adjustable.

13. The method of claim 11, further comprising providing at least one workpiece shifting element on said second workpiece transfer table to temporarily and releasably secure the lateral position of said workpiece thereon and to assist with sliding a workpiece over a top surface of said first workpiece transfer table.

14. The method of claim 11, further comprising providing at least one stop element on said first workpiece transfer table to limit the travel of a workpiece over a top surface of said first workpiece transfer table.

15. The method of claim 11, further comprising providing at least one guide element on said first workpiece transfer table to ensure the proper location and orientation of a shifted workpiece.

16. The method of claim 11, further comprising removing said shifted workpiece from said workpiece transfer tables and placing it onto a die located said subsequent press of said press line.

* * * * *